US005733142A

United States Patent [19]

Clark

[11] Patent Number: 5,733,142

[45] Date of Patent: Mar. 31, 1998

[54] ASSEMBLY FOR RETAINING A RIGHT ANGLED CONNECTOR ON A PRINTED CIRCUIT BOARD

[75] Inventor: Stephen L. Clark, Dillsburg, Pa.

[73] Assignee: Berg Technology, Inc., Reno, Nev.

[21] Appl. No.: 608,631

[22] Filed: Feb. 29, 1996

[51] Int. Cl.[6] ..... H01R 13/66

[52] U.S. Cl. ..... 439/567; 439/79

[58] Field of Search ..... 439/567, 607, 439/95, 609, 571, 79

[56] References Cited

U.S. PATENT DOCUMENTS

| | | | |
|---|---|---|---|
| Re. 32,502 | 9/1987 | Kumar | 439/92 |
| 3,378,806 | 4/1968 | Wilkerson et al. | 339/17 |
| 4,006,872 | 2/1977 | Tanner | 248/27.1 |
| 4,512,618 | 4/1985 | Kumar | 339/14 R |
| 4,630,882 | 12/1986 | Naylor et al. | 339/198 R |
| 4,639,066 | 1/1987 | Shimamiya et al. | 339/132 B |
| 4,643,509 | 2/1987 | Hollyday et al. | 339/147 R |
| 4,709,973 | 12/1987 | Waters et al. | 439/78 |
| 4,721,473 | 1/1988 | DelGuidice et al. | 439/79 |
| 4,824,398 | 4/1989 | Taylor | 439/557 |
| 4,842,552 | 6/1989 | Frantz | 439/557 |
| 4,874,336 | 10/1989 | Marsh | 439/607 |
| 4,878,856 | 11/1989 | Maxwell | 439/540 |
| 4,889,502 | 12/1989 | Althouse et al. | 439/607 |
| 4,911,659 | 3/1990 | Viselli | 439/570 |
| 4,943,244 | 7/1990 | Teck et al. | 439/500 |
| 5,004,430 | 4/1991 | DelGuidice et al. | 439/350 |
| 5,024,607 | 6/1991 | Kachlic | 439/567 |
| 5,044,988 | 9/1991 | Hirayama | 439/571 |
| 5,079,671 | 1/1992 | Garrett et al. | 361/331 |
| 5,147,220 | 9/1992 | Lybrand | 439/567 |
| 5,171,165 | 12/1992 | Hwang | 439/567 |
| 5,184,963 | 2/1993 | Ishikawa | 439/522 |
| 5,228,873 | 7/1993 | Hirai | 439/607 |
| 5,249,974 | 10/1993 | Wang | 439/79 |
| 5,249,983 | 10/1993 | Hirai | 439/573 |
| 5,256,085 | 10/1993 | Tan et al. | 439/607 |
| 5,281,166 | 1/1994 | Yu et al. | 439/571 |
| 5,288,244 | 2/1994 | Lien | 439/362 |
| 5,340,321 | 8/1994 | Hashiguchi et al. | 439/108 |
| 5,344,342 | 9/1994 | Briones | 439/620 |
| 5,356,313 | 10/1994 | Niwa et al. | 439/607 |
| 5,393,247 | 2/1995 | DiOrazio et al. | 439/567 |
| 5,407,364 | 4/1995 | Tzeng et al. | 439/567 |
| 5,415,565 | 5/1995 | Mosquera | 439/567 |
| 5,419,713 | 5/1995 | Northey | 439/329 |
| 5,423,696 | 6/1995 | Sato | 439/607 |

*Primary Examiner*—Khiem Nguyen
*Assistant Examiner*—Eugene G. Byrd
*Attorney, Agent, or Firm*—Daniel J. Long; M. Richard Page

[57] ABSTRACT

Disclosed is a retention device for fixing a component of an electrical connector to a printed circuit board which comprises a body having a central connecting receiving aperture and wings in planes normal to the body which have opposed inwardly extending latches and a pair of downwardly extending resilient latches. The lateral latches will engage ledges adjacent the housing of the receptacle while the downwardly depending latches will engage alignment slots in a mounting foot from the receptacle and the printed circuit board. The central connector receiving aperture will be engaged by a connector which fixes the nose shield to the pin receiving face of the receptacle.

17 Claims, 4 Drawing Sheets

ASSEMBLY FOR RETAINING A RIGHT ANGLED CONNECTOR ON A PRINTED CIRCUIT BOARD

BACKGROUND OF INVENTION

1. Field of the Invention

The present invention relates to electrical connectors and more particularly to devices for holding an electrical connector or component thereof on a printed circuit board.

2. Brief Description of Prior Developments

In the manufacture of various electronic products, it is frequently necessary to mount right angled connectors on a printed circuit board (PCB) and to securely retain the connector in position. When parts of the connector are comprised of an insulative material it may also be necessary to provide a means for grounding conductive elements of the connector to conductive traces on the PCB.

For example, a right angled high pin count (HPC) receptacle may be mounted on a (PCB) in such a way that a concave conductive nose shield is emplaced over the front convex pin receiving face of the HPC receptacle. A conductive tail stock may then be emplaced over the nose shield. Various means have been suggested for connecting the nose shield and the tail stock to the HPC receptacle and for holding the HPC receptacle down on the PCB. Heretofore, however, no such means have allowed for the efficient and cost effective attachment of the tail stock and the nose shield to the HPC receptacle and the HPC receptacle to the PCB while at the same time allowing the tail stock and the nose shield to be grounded to the PCB. A need, therefore, exists for such a retention device.

SUMMARY OF THE INVENTION

The retention device of the present invention may be employed in connecting a component of an electrical connector to a PCB, and preferably it is employed in connecting an HPC receptacle with a conductive nose shield to the PCB. This retention device comprises a body having a central fastener receiving aperture. Depending from this body are a pair of parallel resilient legs, each of which have outwardly extending projections for engaging the bottom side of a printed circuit board after the resilient legs have been inserted into a slot through the PCB. Opposed lateral wing members extend from the body section in the plane normal to the plane of that body section. These wing members are equipped with inwardly extending latching members that engage one or more ledges which project from the insulative housing of the receptacle. Retaining fasteners may then pass through slots or apertures in the tail stock and the nose shield to engage the central connector receiving aperture in the body to thereby fix the nose shield to the HPC receptacle and at the same time fix the HPC receptacle to the PCB and also ground the nose shield to a conductive trace on the PCB.

Also encompassed by this invention is a receptacle mounting assembly which includes a PCB having at least one mounting slot or other aperture. A receptacle is mounted on this printed circuit board. The receptacle has an insulative housing with a transverse pin receiving face and at least one transverse mounting foot which extends from an axial lateral wall having a ledge. The mounting foot has a slot or other aperture aligned with the slot in the printed circuit board. A conductive nose shield member is axially aligned with and adjacent the front pin receiving face of the receptacle and has at least one connector receiving means. The assembly also includes at least one retention member comprising a body having a central connector receiving means and one lateral latching means for engaging the ledge on said housing and a depending latching means for engaging the mounting foot of the receptacle and the PCB through their aligned slots or other apertures. A connector for engaging the connector receiving means on both the nose shield member and the retention member serves to fasten the assembly together and allow the nose shield to be grounded to a conductive trace on the PCB. A conductive tail stock may also be fixed to the assembly and grounded to the PCB by means of this connector.

Finally, the present invention also encompasses a method for mounting a receptacle on a printed circuit board having at least one mounting slot or other apertures.

In this method a receptacle having an insulative housing with a transverse pin receiving face and at least one transverse mounting foot extending from an axial lateral wall having a ledge and said mounting footing having a slot or other aperture is positioned on the PCB so that its slot is aligned with the slot in the PCB. A conductive nose shield having at least one connector receiving means is then positioned adjacent the transverse pin receiving face of the receptacle. A retention member is then inserted through the aligned slots in the mounting foot and the circuit board. This retention member comprises a body having a central connector receiving means and one lateral latching means for engaging the ledge on the housing and a depending latching means for fixing the housing to the circuit board.

Then a conductive connector is inserted through the connector receiving means in the nose shield and the retention member to fix the nose shield to the retention member and ground the nose shield to a conductive trace on the PCB. A conductive front tail stock may also be fixed to the assembly and grounded to the PCB by means of this connector.

BRIEF DESCRIPTION OF THE DRAWINGS

The device of the present invention for connecting a receptacle to a PCB is further described with reference to the accompanying drawings in which.

DETAILED DESCRIPTION OF THE PREFERRED EMBODIMENTS

Figure 2:
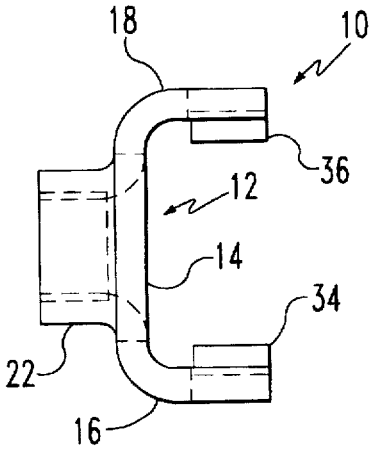
FIG. 2 is a top plan view of the retention device shown in FIG. 1.
Figure 3:
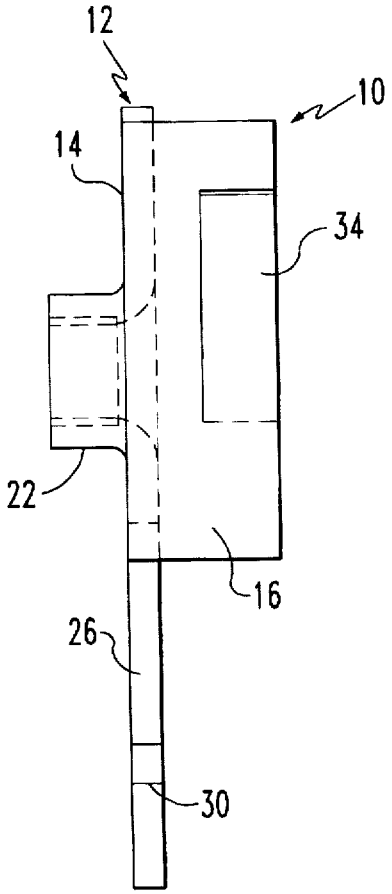
FIG. 3 is a side elevational view of the retention device shown in FIG. 1.
Figure 1:
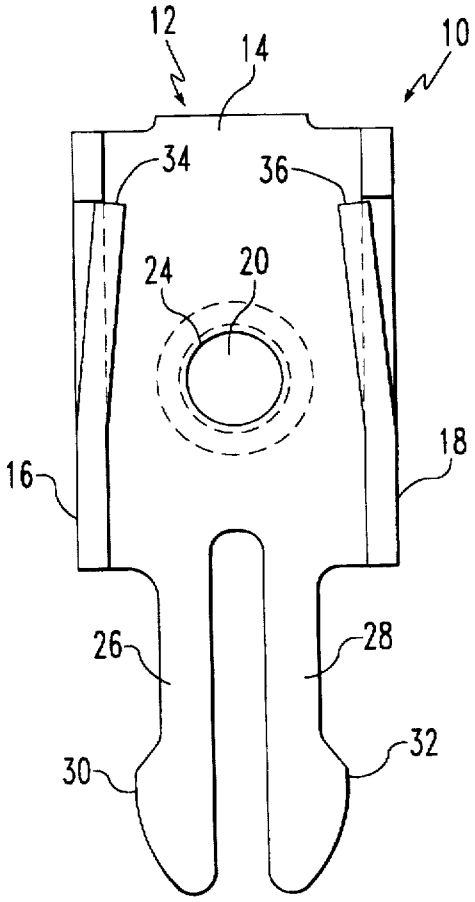
FIG. 1 is a front elevational view of a preferred embodiment of the retention device of the present invention.

Referring particularly to FIGS. 1–3, the retention device is shown generally at numeral 10. This retention device includes a body section 12 which is comprised of a generally flat central plate 14 with opposed lateral wing members 16 and 18 which project perpendicularly from the plate. The plate also includes a central connector receiving aperture 20 which has an adjacent concentric tubular member 22 which projects perpendicularly from the plate section of the body and which has an interior screw thread 24. Extending downwardly from the body there are parallel resilient latch legs 26 and 28 which have at their terminal ends outward latching projections respectively at 30 and 32. On the inner sides of the wing members there are a second pair of lateral inwardly projecting resilient latch members 34 and 36.

Figure 4:
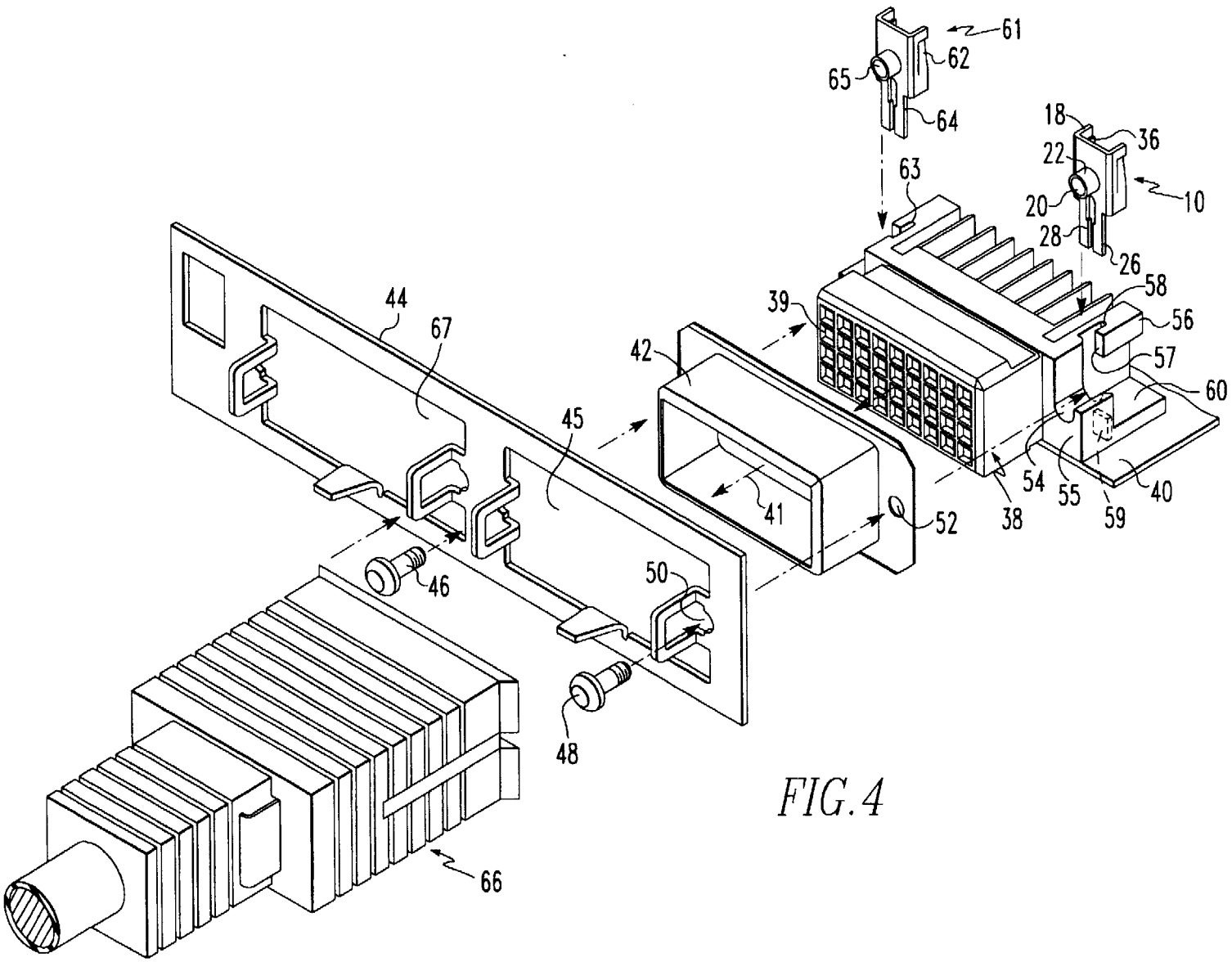
FIG. 4 is a perspective view of a receptacle mounting assembly which includes the retention device shown in FIG. 1.
Figure 6:
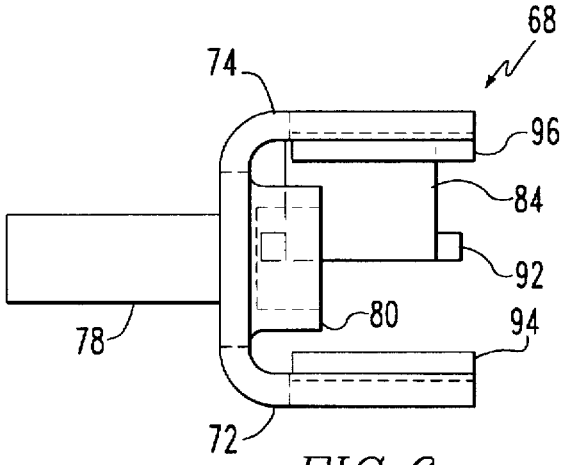
FIG. 6 is a top plan view of the retention device shown in FIG. 5.
Figure 7:
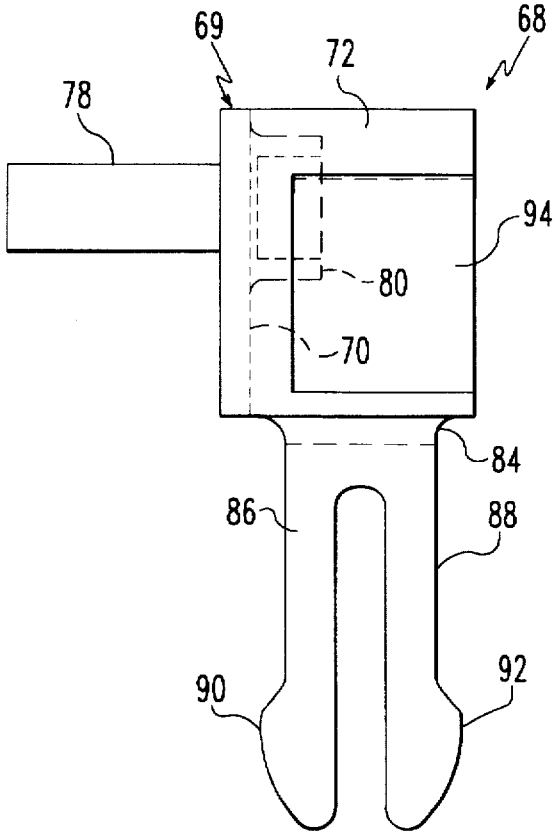
FIG. 7 is a side elevational view of the retention device shown in FIG. 5.
Figure 5:
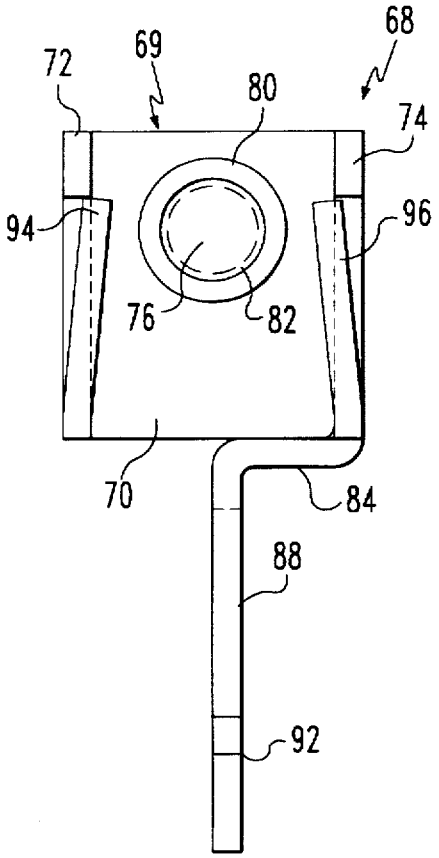
FIG. 5 is a front elevational view of an alternate preferred embodiment of the retention device of the present invention.
Figure 8:
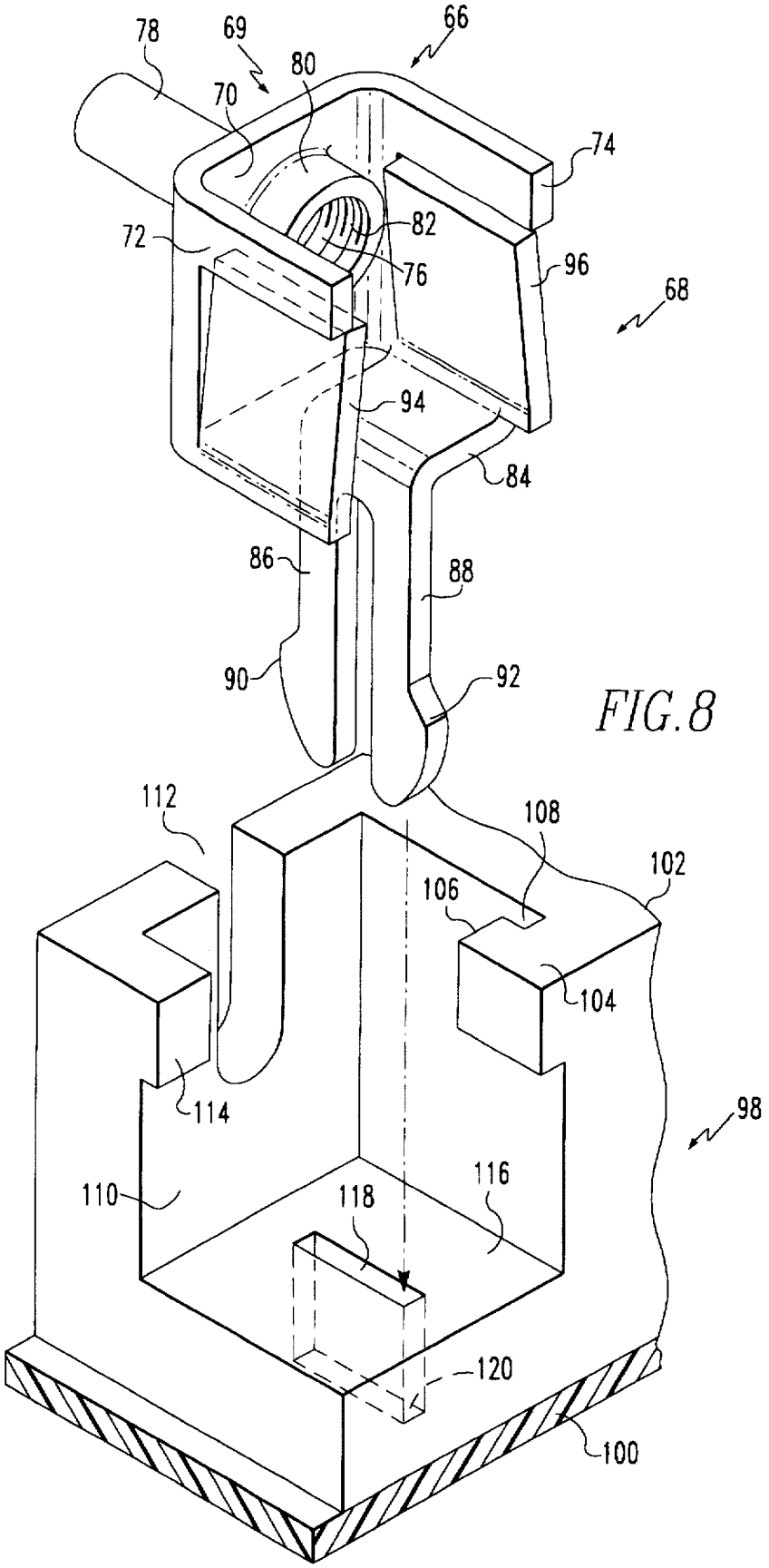
FIG. 8 is a perspective view of the retention device shown in FIG. 5 in use with a receptacle and PCB, the receptacle and PCB both being shown in fragment.

An advantageous employment of the retaining device shown in FIGS. 1–3 is illustrated in FIG. 4 in which a high right angled HPC receptacle is shown generally at numeral 38. The HPC receptacle has a convex front pin receiving face 39 and is mounted on a PCB 40. The HPC receptacle has a longitudinal axis 41, and axially aligned with the HPC receptacle is a concave conductive nose shield 42 which is laterally superimposed over the front pin receiving face of the HPC receptacle. Laterally superimposed over the nose shield is a conductive tail stock 44 and the nose shield and HPC receptacle fit through major aperture 45 in the tail stock. The assembly also includes mounting screws 46 and 48, which passes through apertures as at 50 in the tail stock aperture as at 52 in the nose shield and grooves as at 54 in a transverse extension wall 55 of the HPC receptacle to engage the pin receiving aperture 20 and adjacent tubular member 22 in retention device 10. The HPC receptacle housing includes transverse ledge 56 from the HPC receptacle housing which has an axial projection 57 that forms an axial groove 58. There is also a transverse slot 59 in a mounting foot 60 which mounting foot extends transversely from the HPC receptacle housing. This transverse slot is vertically aligned with another transverse slot (not shown) in the PCB. As the retention device is moved downwardly toward slot 59 wing 18 is engaged with groove 58. As the downward motion continues, resilient latch 36 is flexed from its initial inwardly canted position to a vertical position coplanar with the rest of wing 18 due to the outward lateral force applied to it by axial projection 57. When the top of the resilient latch 36 passes below the bottom edge of projection 57, such lateral pressure on the resilient latch 36 will be released and the latch snaps back to its inwardly canted position. In this inward position the resilient latch will bear against the lower side of projection 57 to resist upward displacement of the retention device. Simultaneously, resilient legs enter slot 59 in the mounting foot and will be pressed together by lateral pressure exerted by the end walls of the slot to allow them to pass vertically through that slot and the aligned slot (not shown) in the PCB. When the outward latching projections 30 and 32 (FIGS. 1–4) pass the bottom end of this slot, lateral pressure on them will be released to allow the resilient legs to expand outwardly so that the outward latching projections engage the bottom side of the PCB. After the resilient legs and the resilient lateral latches are engaged in this way, screw 48 is then engaged with the connector receiving aperture 20 in the manner described above. The mounting of the tail stock and the nose shield on the HPC receptacle and the mounting of the receptacle on the PCB is finalized by means of a second retention device shown generally at numeral 61 which is essentially identical to retention device 10. In the same way as retention device 10 was secured, lateral resistant latch 62 engages ledge 63 and its adjacent projection and groove on the HPC receptacle and resilient legs as at 64 engage aligned transverse slots (not shown) in another mounting foot (not shown) in the receptacle and screw 46 engages screw receiving aperture 65 after it has passed through apertures, respectively, in the nose shield and tail stock which are positioned in opposed relation to apertures 52 and 50. In this way the receptacle will be securely mounted on the PCB and the nose shield and tail stock will be fixed to the receptacle and be grounded to a conductive trace (not shown) on the PCB. The receptacle is engaged with a conventional plug shown generally at numeral 66. It will also be seen that the tail stock has a second major aperture 67. A second receptacle assembly (not shown) similar to the assembly described above may be mounted on the PCB and pass through this aperture 67 and engage a second plug with a shielded cable (not shown). It will also be understood that the tail stock may be horizontally oriented as is illustrated or that the tail stock and its engaging assemblies may alternatively be vertically oriented.

Referring to FIGS. 5–8, a second preferred embodiment of the retention device of the retention device of the present invention is shown generally at numeral 68. This retention device includes a body section 69 which is made up of a central plate 70 and two wing members 72 and 74 which project from the plate in parallel planes normal to the plane of the plate. The plate also includes a central connector receiving aperture 76, and in concentric adjacent relation to this connector receiving aperture there is a front tubular member 78 extending from the front side of the plate and a rear tubular member 80 extending from the rear side of the plate. Inside the tubular member there is also a screw thread 82 which engages a retaining screw in a manner similar to that shown in the first embodiment in FIG. 4. From the lower end of wing member 74 there is a lateral wing extension 84 and from the inner terminal edge of this lateral wing extension parallel resilient legs 86 and 88 extend downwardly in a plane normal to the plane of the plate of the body section. From resilient leg 86 a forward latching projection 90 extends laterally. From the resilient leg 88 a rearward latching projection 92 also extends laterally. From the wing members 72 and 74 a second pair of resilient latches respectively 94 and 96 extend inwardly. The retention device 66 is shown in conjunction with a HPC receptacle shown in fragment generally at numeral 98. The HPC receptacle is mounted on a PCB also shown in fragment at 100. The receptacle includes a housing 102 from which a ledge 104 extends transversely. The ledge includes a forward axial projection 106 which forms with the housing a vertical groove 108. Also extending laterally from the housing is a front wall extension 110 which has a vertical connector receiving slot 112. Projecting rearwardly from the lateral wall extension there is also another ledge 114. There is also a housing mounting foot 116 which rests on the printed circuit board. This housing mounting foot has a longitudinal slot 118 which is aligned with another longitudinal slot 120 in the printed circuit board. The retaining device is engaged within the receptacle by moving it downwardly from the position shown in FIG. 5 until the wing member 74 engages the groove 108, while the wing member 72 laterally abuts ledge 114 which acts as a guide during insertion. As wing member 74 moves downwardly through groove 108 resilient latch 96 will be flexed upwardly to a vertical position to allow it to pass through groove 108. At the bottom edge of ledge 104 where groove 108 ends resilient latch 96 will no longer be vertically restrained, and it will return to its original inwardly canted position, and therefore be restrained from upward vertical movement by means of the ledge 104. At the same time wing member 72 with its resilient latch 94 will pass by ledge 114 and resilient legs 86 and 84 will enter longitudinal slot 118 in the housing foot and then slot 120 in the printed circuit board. These slots will bear on the forward latching projection 90 on resilient leg 86 and the rearward latching projection 92 on resilient leg 86 to force the legs inwardly toward each other and allow them to pass through the slots. After these projections have passed through both slot 118 in the housing mounting foot and slot 120 in the printed circuit board such inward force will no longer bear against them and the resilient legs will again flex outwardly to their original parallel position while the latching projections engage the bottom surface of the printed circuit board to thereby securely mount the HPC receptacle on the printed circuit board. In a manner similar to that shown in FIG. 4, retaining screws engage the central connector receiving aperture 76 and the front and rear tubular members to attach a tail shield (not shown) and a nose shield (not shown) to the HPC receptacle. Thus, the nose shield and tail stock will be securely attached to the HPC receptacle and will also be electrically grounded to a conductive trace (not shown) on the PCB.

It will be appreciated that there has been described a retaining device which allows for efficient and economical mechanical attachment of a right angled connector having an insulative receptacle housing to a PCB while at the same time allowing for grounding of associated conductive elements to the PCB. It will also be appreciated that an essentially identical connector may be used on both sides of an insulative receptacle.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A receptacle mounting assembly for use on a printed circuit board having at least one mounting aperture comprising:

(a) an insulative receptacle mounted on said printed circuit board having an insulative housing with a transverse pin receiving face and at least one transverse mounting foot extending from an axial lateral wall having a transverse ledge having an axial projection and forming an axial groove between said lateral wall and said axial projection and said mounting foot having an aperture aligned with the aperture in the printed circuit board;

(b) a conductive nose shield member axially aligned with and adjacent the front pin receiving face of the receptacle and having a central plug receiving aperture and a lateral fastener receiving aperture;

(c) at least one conductive retention member comprising a body having a central fastener receiving means and at least one lateral latching means for engaging the ledge on said housing and a depending latching means for engaging the mounting foot of the receptacle and the printed circuit board through the aligned apertures in said mounting foot and printed circuit board and wherein said body includes a plate section having at least one lateral wing member projecting in generally normal relation from said body section and said wing member is engageable with said axial groove and said lateral latching means bears against said axial projection from the edge of the lateral wall of the insulative receptacle; and (d) a conductive fastener for engaging the lateral fastener receiving aperture on the nose shield member and the central fastener receiving means on the conductive retention member so as to ground said conductive nose shield through said conductive fastener and said conductive retention member to the printed circuit board.

2. The receptacle mounting assembly of claim 1 wherein the first latching means comprise a pair of spaced generally parallel leg members extending in coplanar relation from the plate section.

3. The receptacle mounting assembly of claim 2 wherein the leg members are inwardly compressible to be receivable in a retaining slot.

4. The receptacle mounting assembly of claim 3 wherein the leg members are laterally expandable to be engageable with said retaining slot.

5. The receptacle mounting assembly of claim 4 wherein the leg members have outwardly extending engagement projections.

6. The receptacle mounting assembly of claim 1 wherein the central connector receiving means is an aperture in the plate section having a peripheral tubular projection.

7. The receptacle mounting assembly of claim 6 wherein the peripheral tubular projection is positioned in generally normal relation to the plate section.

8. The receptacle mounting assembly of claim 3 wherein the slot is in a printed circuit board.

9. The receptacle mounting assembly of claim 1 wherein the fastener also fixes a conductive front tail stock to the assembly.

10. The receptacle mounting assembly of the claim 9 wherein the conductive front tail stock has an aperture aligned with the central plug receiving aperture of the conductive nose shield.

11. The receptacle mounting assembly of claim 9 wherein the front tail stock is superimposed over the conductive nose shield.

12. The receptacle mounting assembly of claim 9 wherein the lateral fastener receiving aperture.

13. The receptacle mounting assembly of claim 9 wherein the front tail stock is grounded to the printed circuit board through the conductive member.

14. The receptacle mounting assembly of claim 1 wherein the lateral latch is canted inwardly toward the fastener receiving means of the conductive retention member.

15. The receptacle mounting assembly of claim 14 wherein the lateral latch bears against the axial projection to resist displacement of the conductive retention member.

16. The receptacle mounting assembly of claim 15 wherein the lateral latch of the conductive retention member is engageable with the axial projection as the conductive retention member is moved downwardly through the aligned axial groove aperture in the printed circuit board.

17. The receptacle mounting assembly of claim 16 wherein the axial projection applies lateral pressure on the lateral latching means to flex said lateral latching means to a vertical position after which said latching means returns to its vertical position as said latching means moves downwardly past the axial projection.

* * * * *